United States Patent [19]

Dear et al.

[11] Patent Number: 4,832,147

[45] Date of Patent: May 23, 1989

[54] SOUND REDUCTION MEMBRANE

[75] Inventors: Terrence A. Dear, Elkton, Md.; Karl U. Ingard, Kittery Point, Me.; Stephen P. Scheinberg, Wilmington, Del.

[73] Assignee: E. I. DuPont de Nemours and Company, Wilmington, Del.

[21] Appl. No.: 67,723

[22] Filed: Jun. 19, 1987

[51] Int. Cl.[4] ..... E04B 1/82

[52] U.S. Cl. ..... 181/30; 181/286; 181/293; 181/294; 181/295

[58] Field of Search ..... 181/30, 284, 288, 293, 181/295, 286, 291, 294

[56] References Cited

U.S. PATENT DOCUMENTS

| | | | |
|---|---|---|---|
| 1,730,529 | 10/1929 | Robbins | 181/30 |
| 2,502,016 | 3/1950 | Olson | 181/295 |
| 2,502,017 | 3/1950 | Beers | 181/30 X |
| 2,882,989 | 4/1959 | Bruel et al. | 181/295 |
| 2,923,372 | 2/1960 | Maccaferri | 181/284 |
| 3,087,572 | 4/1963 | Baruch et al. | 181/286 |
| 3,578,105 | 5/1971 | Griff | 181/295 |
| 4,152,474 | 5/1979 | Cook et al. | 181/291 X |
| 4,362,222 | 12/1982 | Hellstrom | 181/30 |
| 4,420,526 | 12/1983 | Schilling et al. | 181/294 X |
| 4,529,637 | 7/1985 | Hankel | 428/49 |
| 4,548,292 | 10/1985 | Noxon | 181/295 |
| 4,584,232 | 4/1986 | Frank et al. | 181/288 X |
| 4,630,707 | 12/1986 | Yukawa | 181/288 |

OTHER PUBLICATIONS

Absorption Properties of Baffles for Noise Control in Industrial Halls, A. Cops, Applied Acoustics 18 (1985) 435–448.

Compendium of Materials for Noise Control, Robert A. Hedeen, U.S. Dept. of Health, Education & Welfare, Contract 210-77-00-63, May, 1980.

Development of Porous Aluminum and Porous Alloy Sheets, Morimoto et al., Twenty-Ninth Technology Prize, pp. 40–44.

*Primary Examiner*—B. R. Fuller

[57] ABSTRACT

A volumetric sound absorber for audible sound frequencies is made from a thin sheet material that is permeable to air with thickness, mass, and flow resistance within specified ranges.

9 Claims, 4 Drawing Sheets

Fig. 9
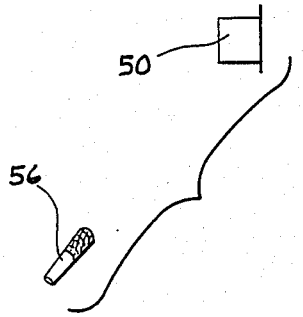
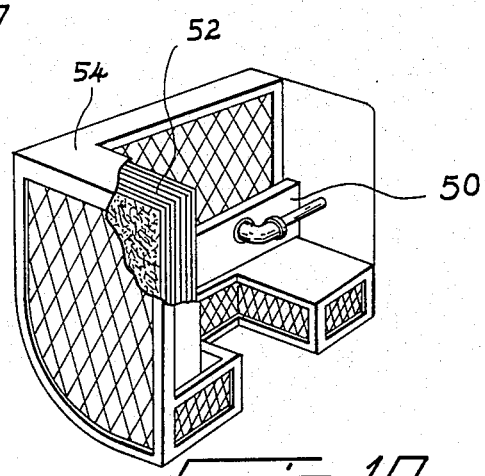
Fig. 10
Fig. 11
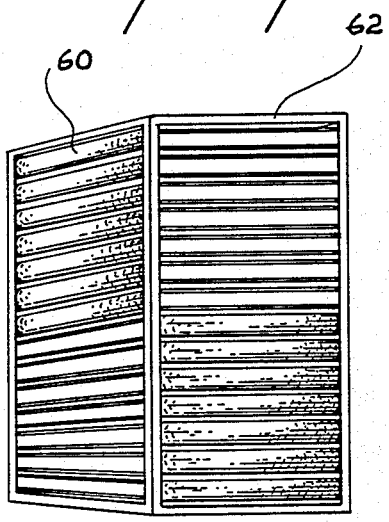
Fig. 12
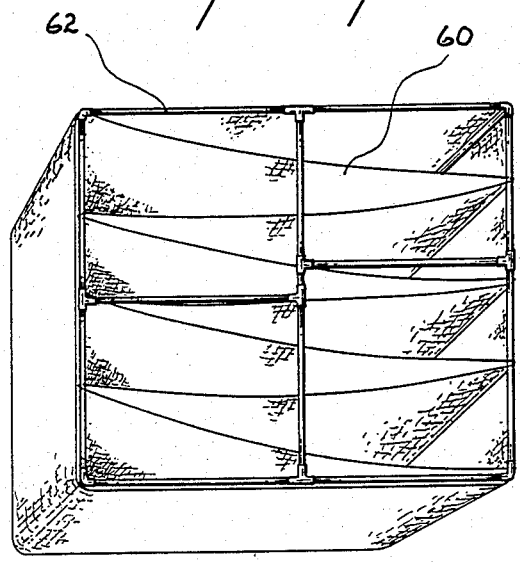

SOUND REDUCTION MEMBRANE

BACKGROUND OF THE INVENTION

This invention relates to reducing noise levels, and more particularly, it relates to volumetric sound absorbers for audible sound frequencies.

One method of reducing the reverberant noise level in a room involves the use of what is commonly referred to as "volume" absorbers. This name refers to the fact that unlike "surface" absorbers, these absorbers are not applied on the ceiling or walls in the room but are hung from supports throughout the volume of the room. Some of the commercially available volume absorbers mimic the surface absorbers, and, like most surface absorbers, have relatively poor absorption at low frequencies. Furthermore, they are unnecessarily complicated and heavy.

SUMMARY OF THE INVENTION

To improve upon the above-noted deficiencies in known methods for reducing noise level, this invention provides a volumetric sound absorber for audible sound frequencies in a sound field. The absorber comprises a suspended sheet material permeable to air and having a mass of from about 1 to about 35 oz/yd$^2$. The sheet material ranges in thickness from about 0.2 mm to about 3.0 mm and has a flow resistance (rho-c or $\rho c$) of from about 0.5 to about 5.0 $\rho c$ units, where $\rho$ is the density of air and c is the speed of sound in air at the measured temperature (all in cgs units).

The sound absorber performs independent of material of construction and may take various shapes providing the mass, thickness and flow resistance of the sheet material fall within the ranges specified above.

BRIEF DESCRIPTION OF THE DRAWINGS

FIGS. 9 and 10 are schematic illustrations of a sound absorber of this invention used to reduce a point source of sound as per Example 3.

FIGS. 11 and 12 are schematic illustrations of other configurations for the sound absorber of this invention.

DETAILED DESCRIPTION OF THE PREFERRED EMBODIMENTS

Figure 1:
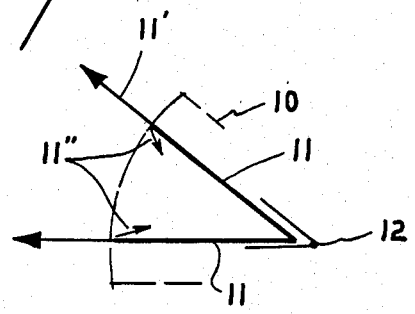
FIGS. 1 and 2 are schematic illustrations of directed and diffuse sound fields and the effect on their intensity of the sound absorber of this invention.
Figure 2:
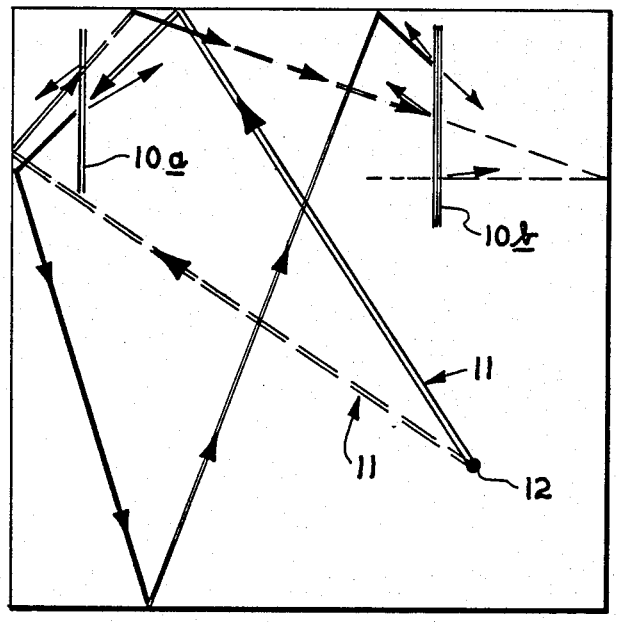

Referring to FIGS. 1 and 2 when the thin sheet sound absorber 10 is placed directly in the near field 11 of a point sound source 12 the sound absorber acts as a shield and reduces the sound intensity via transmission loss as represented by reduced sized arrow 11' through sheet 10. (A small fraction of the sound is reflected as indicated by 11''.)

In a uniform diffuse sound field within a room 20 such as represented in FIG. 2 the sound waves 11 from source 12 impinge on sound absorbers **10*a* and 10*b* from both sides in an uncorrelated manner and at different angles as reflected from the walls of the room. The absorbers 10*a*, 10*b*** are two-sided absorbers, i.e., they are effective from both sides when placed in the volume of a room. Furthermore, a room treated with this sheet material can be tuned for music performance, speech, sports, etc.

The performance of the thin sheet sound absorber is independent of material of construction providing the parameters of mass, thickness, and flow resistance ($\rho c$) are maintained within the limits specified above. Therefore, it may be made of any thin controlled porosity material such as:

- Nonwoven fabrics including spunbonded, spunlaced, carded and needled; thermally, chemically and resin bonded etc;
- Sintered metals, glass and/or plastics from granular or fibrous particles, etc.;
- Resin bonded natural materials such as wood fibers or sawdust, natural fibers, crushed shell or minerals;
- Open cell foams;
- "Melt blown" sub-denier fiber sheets (nonwovens) of glass or synthetic polymers;
- Calendered or tightly woven fabrics of natural or synthetic fibers, glass or mineral wool;
- Nonwoven fabrics calendered to control porosity;
- Woven fabrics with fibrillatable synthetic fibers or fiber cross-sections (e.g., trilobal polyester; Kevlar®) which are then subjected to hydraulic needling to create a more closed, controlled porosity cross-section;
- Finely perforated thin sheets of: metal, plastic, film, rubber, paper, etc.;
- Porous resin impregnated woven, stitchbonded and nonwoven fabrics, etc.;
- Microporous membranes and films of the desired flow resistances regardless of how manufactured;
- Porous woven and nonwoven or stitchbonded fabrics or films etc. which have been shrunk by heat or other means to tighten them up;
- Fabrics or other open structures which have been coated with a discontinuous film on one or both sides to control porosity;
- Laminates;
- Other materials obvious as related to those above;
- All or any of the above materials treated for flame retardancy;
- Any of the above dyed or printed in a decorative manner.

The thin sheet sound absorber of this invention may be mounted in a volume in a number of ways such as:

- on drapery rods;
- suspended by wires;
- as continuous lengths or a number of short pieces;
- like flags or banners;
- with or without stiffening wires, weights, or sticks on one or more sides;
- in frames: flat or three-dimensional;
- flat, curved, or twisted in space to form a decorative architectural feature;
- as decorative kites, large open honeycomb sections of various configurations, or decorative fans, bells, balls, doves, etc., like giant paper party decorations;
- flat; in smooth undulations like a drape; in sharp pleats or folds;
- horizontally, vertically, obliquely.

Figure 3:
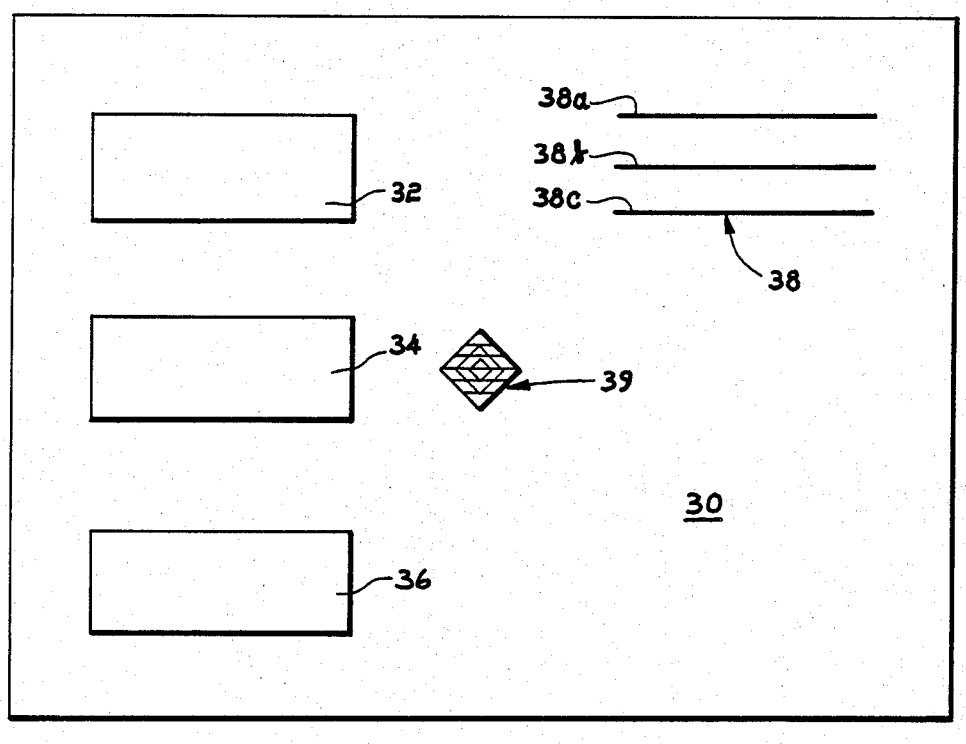
FIGS. 3 and 4 are schematic illustrations of plan and side elevation views respectively of a room showing various configurations of the volumetric sound absorber of this invention.
Figure 4:
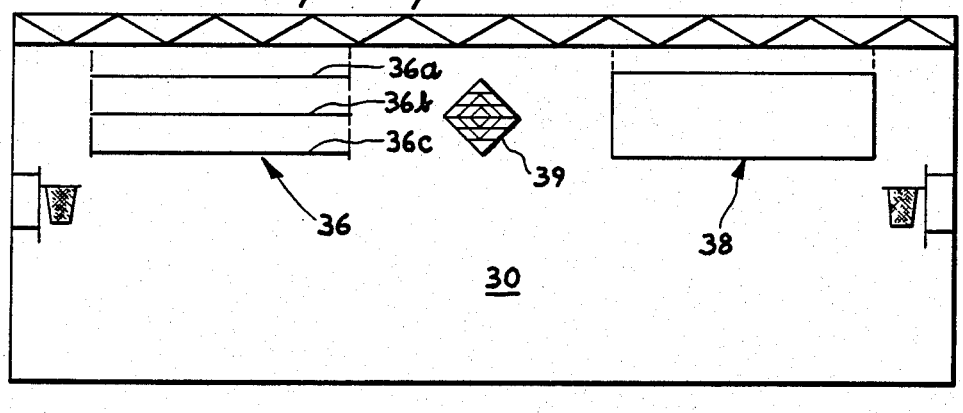

FIGS. 3–4 are schematic illustrations of the room equipped with thin sheet sound absorbers of this invention as used to prepare Example I. More particularly, the room generally designated 30 is shown provided with five groupings designated 32, 34, 36, 38 and 39 suspended in the room. Groups 32, 34 and 36 are comprised of three sheets designated by subscripts a, b, c respectively. 36*a*, 36*b* and 36*c* are seen in FIG. 4. The group designated 38 is comprised of sheets 38*a*, 38*b* and 38*c*. A tension sculpture in the form of a kite is designated 39 and is shown in enlarged perspective view in FIG. 5.

Figure 6:
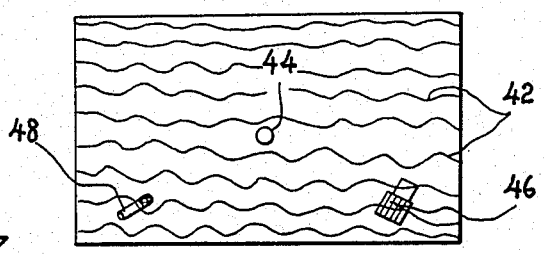
FIGS. 6, 7 and 8 are schematic illustrations of plan, front and side elevation views, respectively, of a room with another configuration of the sound absorber of this invention.
Figure 7:
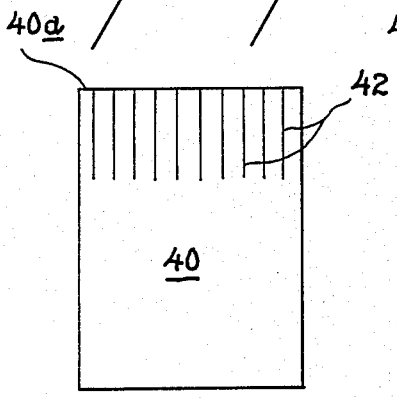
Figure 8:
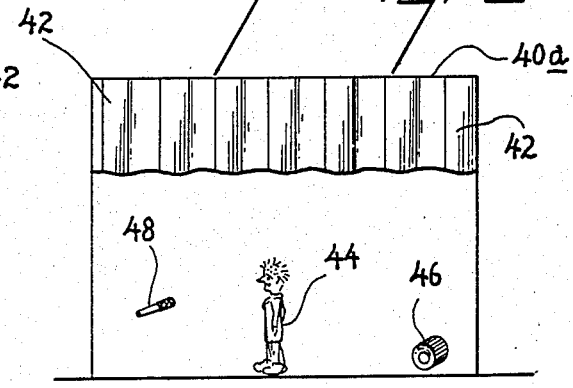

FIGS. 6, 7 and 8 are schematic illustrations of the room equipped with thin sheet sound absorbers of this invention as used to prepare Example II. More particularly room 40 includes nonwoven sheets 42 of the thin sheet sound absorber of this invention hung vertically from the ceiling 40*a* of the room. The room is shown with a person 44 speaking at the center of the room, a sound generator 46 and a microphone 48 located within the room.

FIGS. 9 and 10 are schematic illustrations of the sound absorber of this invention used to reduce sound emanating from an air jet 50 used to entangle fibers as per Example III. The sound absorber 52 is placed within a support member 54, i.e., a porous cage, enclosing a major portion of the field of sound from the jet. A microphone 56 is used to detect sound intensity.

FIGS. 11 and 12 show the thin sheet sound absorbing material 60 supported in frames 62 in layers spaced apart from each other.

Example I

Figure 5:
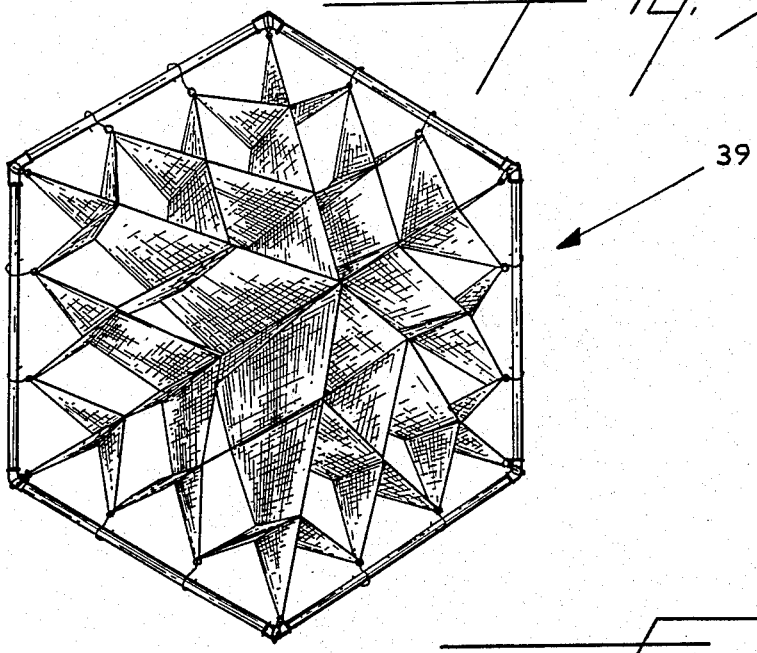
FIG. 5 is an enlarged perspective view of one of the sound absorbers shown in FIGS. 3 and 4.

As shown in FIGS. 3–5, the gymnasium/multipurpose room 30 of a school is 44 feet 8 inches wide (13.6 m), 65 feet long (19.8 m) and 23 feet high (7.0 m), a volume of 66,800 cubic feet (1890 cubic m). The walls are concrete block sealed with smooth enamel paint and the ceiling is a bare steel decking supported by steel beams. The floor is covered by indoor-outdoor carpeting. Reverberation time of this room (RT-60), measured at 100 hz, is 3.2 seconds. This makes voice intelligibility unacceptable, and music performance impossible. 4 oz/sq yd (136 g/sq m) polypropylene nonwoven Thin Sheet Sound Absorber with a rho-c of 0.6 was suspended in the overhead space in five locations 32, 34, 36, 38 and 39 (FIG. 3) and four configurations, A, B, C, D, totaling 1254.6 sq ft area (116.6 sq m). Sound absorber sheet thickness was 20 mils (0.5 mm).

A. Three 6 foot by 16 foot sheets a, b, c as shown in location 32, 24 and 36 in FIG. 4 (1.8×4.8 m) spaced parallel 1.5 feet apart (0.45 m) nd hung horizontally.

B. The same grouping as A. hung with the 6 foot side vertical and the 16 foot side parallel to the ground as shown in location 38 in FIG. 3 and 4.

C. The same grouping as A. tilted at a 30 degree angle to the floor, with the surface of the sheet facing the end wall at a 60 degree angle.

D. A 7.4 square yard (5.9 sq m) tension sculpture in the form of a "kite" (FIG. 5) designated 39 in FIGS. 3 and 4.

Reduction in room reverberation was as follows:

| Absorber Total Area, sq ft (sq m) Location (32, 34, 36, 38, 39)/ Configuration (A, B, C, D) | RT-60 Reverboration Time, seconds at 100 Hz |
|---|---|
| 0 (0) No absorber | 3.2 |
| 288 (26.8) 32/A | 2 5 |
| 1254.6 (116.6) 32/A, 34/A, 36, 38/B, 39/D | 1.7 |
| 1254.6 (116.6) 32/A, 34/A, 36/C 38/B, 39/D | 1.2 |

Example II

A sound testing room 40 (FIGS. 6–8) is constructed of concrete and is 14 feet (4.27 m) wide by 25 feet (7.62 m) long by 19 feet (5.79 m) high. Total volume is 6,650 cubic feet (188 $m^3$). Tests compare the empty room to the same room in which 2700 square feet (251 $m^3$) of 4 oz/square yard (136 $g/m^2$) polypropylene nonwoven sheet 42 with flow resistance of 0.6 rho-c was hung vertically from the ceiling in 6 ft (1.8 m) heights by 35 foot (10.5 m) lengths, 1 foot (0.3 m) apart, substantially parallel to the 25 foot (7.5 m) long walls. The sound absorber sheet thickness was 20 mils (0.5 mm). The additional 10 foot (3 m) sheet length was taken up by sinusoidal draping, so the sheets 42 were essentially parallel to each other. A sound source 46 and a receiver 48 (microphone) were located as shown in FIGS. 6, 8, so the sheet was out of the near field of the sound source, and is hanging in a diffuse field. Experimental results A, B and C compare the empty room to the condition with sheet hung from the ceiling.

A. Reverberation reduction

| Sheet Absorber Area square feet (sq. m.) | RT-60 Reverberation seconds at 100 Hz |
|---|---|
| 0 (no sheet) | 3.80 |
| 1050 (97.5) 5 sheets | 2.17 |
| 2100 (196) 10 sheets | 1.11 |

B. Sound Reduction

A standard squirrel cage sound generator (ILG Industries, 2850 N Pulaski Rd., Chicago, Ill. 60641) was used to generate an 87 dbA sound level in the empty room.

When 2100 sq ft (196 $m^2$) of thin sheet absorber was hung as described above, a reduction of 8 dbA was achieved.

C. Voice Audibility

1. No sound generator. A person 44 (FIGS. 6 and 8) speaking at center of room.

When a set speech of several lines was read at normal voice volume, the speaker's voice became louder and slower involuntarily, because echoes of his words confused him. Words just then spoken, and words from up to three sentences back could be heard. A recording made through the instrument pickup microphone, sounds garbled and difficult to understand.

When thin sheet sound absorber was installed overhead, the voice could be heard clearly at normal speaking volume, with no echo of words. Speed of enunciation remained constant, and there was only a trace of room 'ring' (like that of an empty apartment).

2. ILG sound generator 46 on. Person 44 (FIG. 8) speaking at center of room.

With no sound absorber installed, the room had a sound level typical of a factory operating area. The speaker's voice got louder to compensate for the surrounding noise which made it difficult to hear himself. The voice was just barely detectable amid the background din. Only fractions of words were occasionally recognizable as speech, but the meanings were unintelligible.

With thin sheet sound absorber 42 installed in the overhead volume, background sound level was reduced as described in Example II B. The spoken voice was steady in both speed and volume, clear, and easily understood.

Example III

FIG. 9 shows a microphone placed 6¾ inches (17.15 cm) away from the bottom edge of an air jet 50 used to entangle fibers in a textile spinning process. This simulated the position an operator's ear would be in while stringing up the windups. Sound level was 123.5 db.

Two forms of thin sheet sound absorber were tested in porous cage 54 between the source and receiver (FIGS. 10, 11).

A. 4 oz/sq.yd. (136 g/m$^2$) polypropylene spunbonded nonwoven with a sheet thickness of 20 mils (0.5 mm) and a flow resistance of 0.6 rho-c units.

B. 3.5 oz/sq.yd. (119 g/m$^2$) hydraulically interlaced polyaramid nonwoven with a sheet thickness of 8 mils (0.2 mm) and a flow resistance of 3.1 rho-c units.

| SOUND LEVEL - DECIBELS (db) | | |
|---|---|---|
| Thin Sheet Absorber > | A | B |
| Number of Layers | | |
| 0 | 123.5 | 123.5 |
| 5 | 115.6 | 106.2 |
| 15 | 108.6 | 102.8 |

When this experiment was repeated with a moving threadline, the results were identical.

Example IV

A church has dimensions 38.5×65.5×10 ft. with a 14.25 ft peaked ceiling running its length (11.73×19.96×3.05 m; 4.34 m peak). Room volume is 26,610 cubic feet (753 m$^3$). Walls and ceiling are plaster over plasterboard, and the floor is carpeted.

Handclaps anywhere in the church hall resulted in 8–10 echoes, consisting of both lengthwise and side-to-side flutter. The spoken word had excessive reverberation, especially near the ends of the room.

A. Reverberation—Voice Audibility Thin sheet sound absorber was installed as drapes on the back wall (twice the area of the wall) and eight 4×8 foot panels (1.2×2.4 m) on each side wall, directly opposite each other. The back drapes were hung at a 1 foot (30 cm) centerline from the wall, and the flat panels were hung 10 inches (25.4 cm) from the side walls. Handclaps were reduced to 1 echo. Voice, while still slightly reverberant, no longer confused the speaker.

B. Reverberation—RT 60

A random sound generator was used to fill the room with "pink sound", which was cut off suddenly to allow RT-60 reverberation measurements at various frequencies in the audible sound range. Results were as follows:

| ROOM REVERBERATION - SECONDS (AVERAGE OF 5 MEASUREMENTS) | | |
|---|---|---|
| OCTAVE BAND CENTER FREQUENCY, Hz | WITH ABSORBER | NO ABSORBER |
| 100 | .95 | 1.19 |
| 200 | 1.09 | 1.43 |
| 400 | 1.02 | 1.42 |
| 800 | .70 | .95 |
| 1600 | .57 | .77 |
| 3150 | .55 | .76 |
| 6300 | .53 | .61 |

We claim:

1. A volumetric sound absorber for all audible sound frequencies in a sound field within a volume defined by at least one reflective supporting surface, said sound absorber comprising: a porous sheet material suspended away from said surface, from supports extending from said surface within the volume, said sheet having a mass of from about 1 to about 35 oz/yd$^2$, said sheet being permeable to air and having a thickness from about 0.2 mm to about 3.0 mm with a flow resistance of from about 0.5 to about 5.0 $\rho c$ units, said volumetric sound absorber from any reflective surface of said volume for purposes of sound absorption.

2. The sound absorber of claim 1, said sound field being a diffuse sound field, said sound absorber having a plurality of surfaces capable of absorbing said sound frequencies.

3. The sound absorber of claim 1, said sound field being a directed sound field.

4. The sound absorber of claim 1 wherein said sound absorber comprises a plurality of sheets suspended in said sound field.

5. The sound absorber as in claims 1, 2 or 3 wherein said sound absorber is formed into three dimensional shapes of various curvilinear and planar forms defining open structures.

6. The sound absorber of claim 1 wherein said material is a flame retardant fabric.

7. The sound absorber of claim 4 wherein said material is a nonwoven fabric.

8. The sound absorber of claim 7 wherein said nonwoven fabric is spunbonded polypropylene.

9. The sound absorber of claim 7 wherein said nonwoven fabric is hydraulically interlaced polyaramid.

* * * * *

UNITED STATES PATENT AND TRADEMARK OFFICE

CERTIFICATE OF CORRECTION

PATENT NO. : 4,832,147

DATED : May 23, 1989

INVENTOR(S) : Terrence Arnold Dear, et al.

It is certified that error appears in the above-identified patent and that said Letters Patent is hereby corrected as shown below:

Col. 6, line 35, after "absorber" insert --being independent of any distance of said sound absorber--;

Signed and Sealed this

Third Day of November, 1992

*Attest:*

DOUGLAS B. COMER

*Attesting Officer*

*Acting Commissioner of Patents and Trademarks*